US011766134B1

(12) United States Patent
Carron

(10) Patent No.: US 11,766,134 B1
(45) Date of Patent: Sep. 26, 2023

(54) BEDDING CLIP AND METHOD OF USE

(71) Applicant: Tony Doyle Carron, Mill Spring, MO (US)

(72) Inventor: Tony Doyle Carron, Mill Spring, MO (US)

( * ) Notice: Subject to any disclaimer, the term of this patent is extended or adjusted under 35 U.S.C. 154(b) by 0 days.

(21) Appl. No.: 17/541,800

(22) Filed: Dec. 3, 2021

(51) Int. Cl.
*A47C 21/02* (2006.01)

(52) U.S. Cl.
CPC ..... *A47C 21/022* (2013.01)

(58) Field of Classification Search
CPC ..... A47C 21/02; A47C 21/022; A47C 21/024; A47C 21/026; A47C 21/028
See application file for complete search history.

(56) References Cited

U.S. PATENT DOCUMENTS 348,427 A * 8/1886 Thomas ..... A47C 21/022 24/72.5
555,746 A * 3/1896 Snyder ..... A47C 21/022 24/538
1,359,430 A * 11/1920 Richards ..... A47C 21/028 5/504.1
1,513,009 A * 10/1924 Robb ..... A47C 21/022 24/72.5
1,561,922 A * 11/1925 Heath ..... A47C 21/022 24/72.5
1,584,387 A * 5/1926 Littlejohn ..... A47C 21/022 5/498
2,794,757 A * 6/1957 John ..... A47C 21/022 428/125
3,296,668 A * 1/1967 Aiken ..... A47C 21/022 24/51
3,506,988 A * 4/1970 Saddoris ..... A61G 7/05 5/492
4,541,137 A * 9/1985 Murray ..... A47C 21/022 24/72.5
4,712,262 A * 12/1987 Viggiano ..... A47C 21/022 24/72.5
4,723,816 A * 2/1988 Seibert ..... A47C 21/022 297/452.56
4,794,660 A * 1/1989 Hawkrigg ..... A47C 21/022 24/72.5
8,918,931 B1 * 12/2014 Baker ..... A47C 21/022 5/659
2005/0055771 A1 * 3/2005 El Guermaai ..... A47C 21/022 24/72.5
2005/0125903 A1 * 6/2005 Tapanes ..... A47C 21/022 5/504.1
2008/0222807 A1 * 9/2008 Hanes ..... A47C 21/022 5/498
2012/0233777 A1 * 9/2012 Hare ..... A47C 21/022 5/498
2014/0115782 A1 * 5/2014 Ben-Harush ..... A47C 21/022 5/498
2014/0345089 A1 * 11/2014 Kaalberg ..... A47C 21/022 24/72.5

* cited by examiner

*Primary Examiner* — David R Hare
*Assistant Examiner* — George Sun
(74) *Attorney, Agent, or Firm* — Leavitt Eldredge Law Firm

(57) ABSTRACT

A bedding clip for keeping a bedding top sheet and cover together and preventing both from becoming displaced from one another is disclosed. The bedding clip includes a first jaw having opposing ends; a second jaw having opposing ends; a coupling portion joining the first and second jaws; and a sleeve configured to encompass the bedding clip therein.

1 Claim, 5 Drawing Sheets

BEDDING CLIP AND METHOD OF USE

BACKGROUND

1. Field of the Invention

The present invention relates generally to bedding, and more specifically to a bedding clip that holds a bed sheet and cover together on a mattress in a tangle-free condition.

2. Description of Related Art

Bedding is commonly used to cover the mattress of a bed with various materials for hygiene purposes, aesthetics, and for comfort. Traditionally, bedding consists of a fitted sheet that accommodates the mattress, a flat top sheet, and a cover (e.g., blanket, quilt, comforter, duvet, etc.).

One of the problems commonly associated with bedding is maintaining the top sheet and cover together. For example, when a user is occupying the bed, the top sheet and cover can inadvertently become displaced to an undesired position. This can be caused from typical tossing, turning, twisting, or other movement by the user. In addition, the displaced top sheet and cover often become tangled, making it cumbersome for the user to untangle and reposition the top sheet and cover to the desired state.

Accordingly, it is an object of the present invention to provide a bedding clip that maintains a top sheet and cover together in a tangle-free condition.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
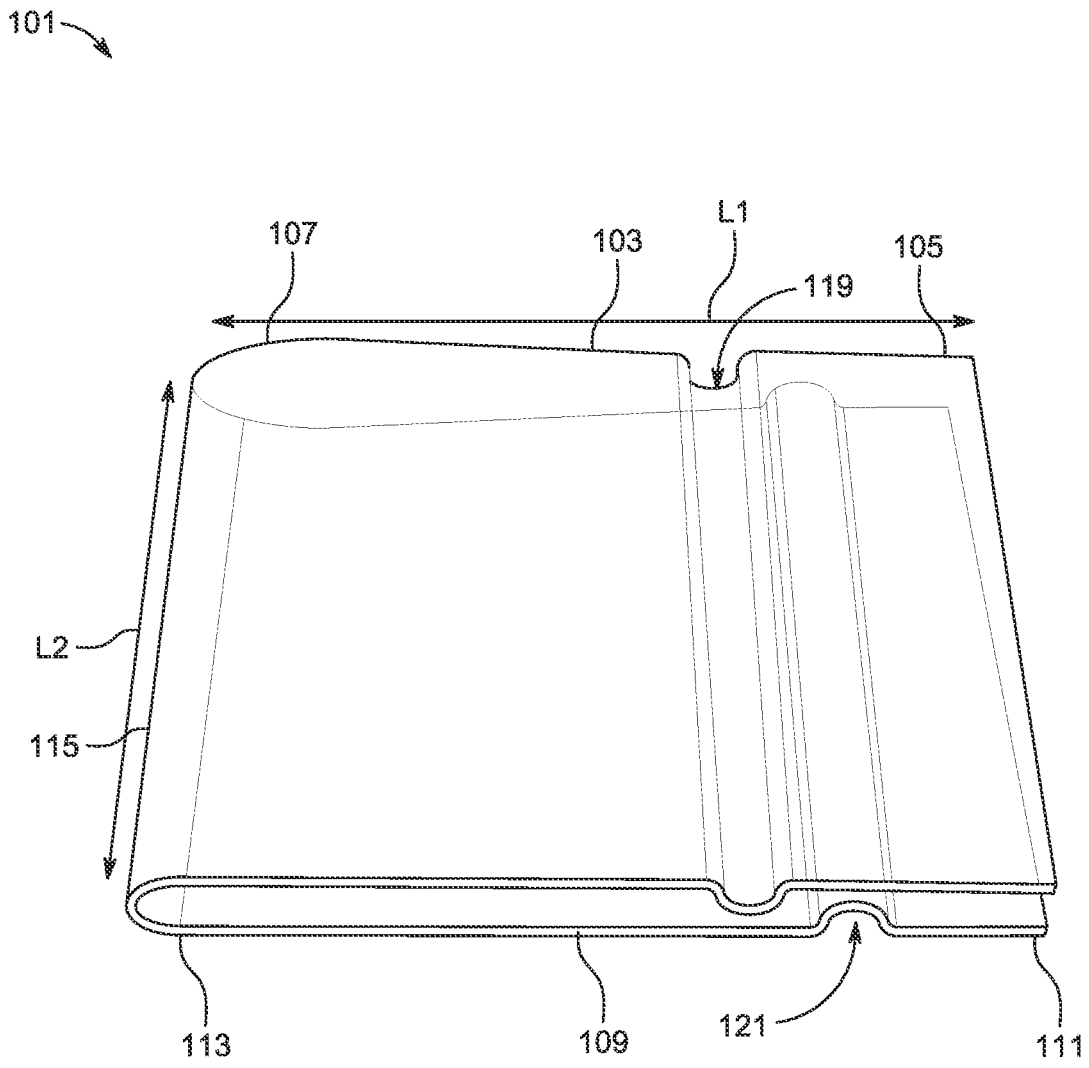
FIG. 1 is a top perspective view of a bedding clip in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional bedding. Specifically, the present invention provides a means for preventing top sheet and cover from becoming displaced during use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
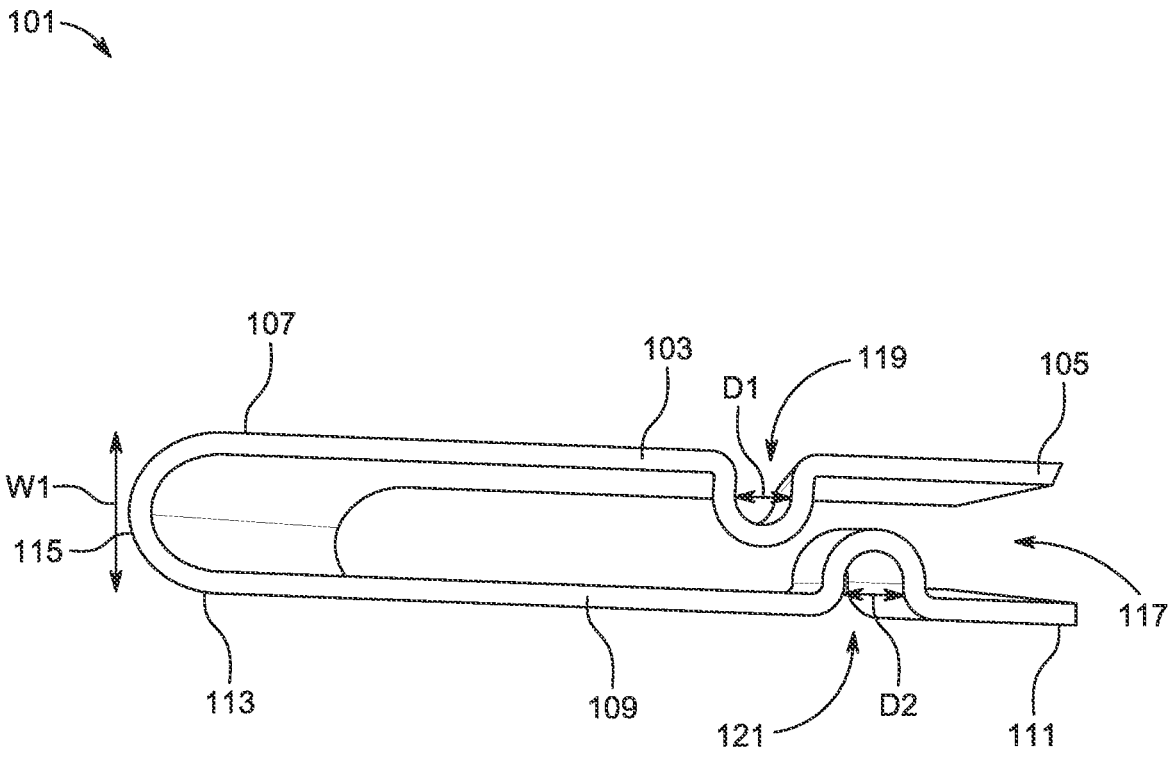
FIG. 2 is a side view of the bedding clip of FIG. 1.

Referring now to the drawings wherein like reference characters identify corresponding or similar elements throughout the several views, FIGS. 1 and 2 depict various views of a bedding clip 101 in accordance with a preferred embodiment of the present application. It will be appreciated that the bedding clip 101 overcomes one or more of the above-listed problems commonly associated with conventional bedding. In addition, it should be appreciated that the bedding clip 101 may vary based on aesthetical, functional, or manufacturing considerations.

In the contemplated embodiment, the bedding clip 101 comprises a first jaw 103 having first and second opposing ends 105, 107, a second jaw 109 having third and fourth opposing ends 111, 113 and a coupling portion 115. First and third ends 105, 111 are free ends and extend away from the coupling portion 115. The coupling portion 115 joins second and fourth ends 107, 113 thereto, creating an opening 117 between the first and second jaws 103, 109. It should be appreciated that the first and second jaws 103, 109 are generally parallel and opposed to one another.

In addition, the first jaw 103 includes a recessed channel 119 extending perpendicularly thereon. The second jaw 109 includes a cambered channel 121 extending perpendicularly thereon. The recessed channel 119 and the cambered channel 121 are generally parallel, opposed and offset to one another.

By way of example and not by way of limitation, the first and second jaws 103, 109 have a length L1 of approximately 4⅜ inches; the coupling portion 115 has a length L2 of approximately 3 inches and a width W1 of approximately ⅝ inches; the recessed channel 119 has a diameter D1 of approximately ½ inches; and the cambered channel 121 has a diameter D2 of approximately 1½ inches. It should be appreciated that the value of L1, L2, W1, D1, and D2 may be set to other suitable values.

It should be appreciated that the bedding clip 101 may be made from any suitable or desirable materials, including conventional materials known and used in the art, such as plexiglass, plastic, metal, combinations of various materials, and the like.

It should also be appreciated that the bedding clip 101 may have a wide range of sizes, thicknesses, weights, densities, etc., depending upon the dimensions of the top sheet and cover being used.

Further, it should be appreciated that one of the unique features believed characteristic of the present application is that it provides a means for keeping a top sheet and cover together and thus preventing both from becoming displaced or otherwise misaligned from one another during use, thereby allowing for easy and tangle-free making of the bed after use.

Figure 3:
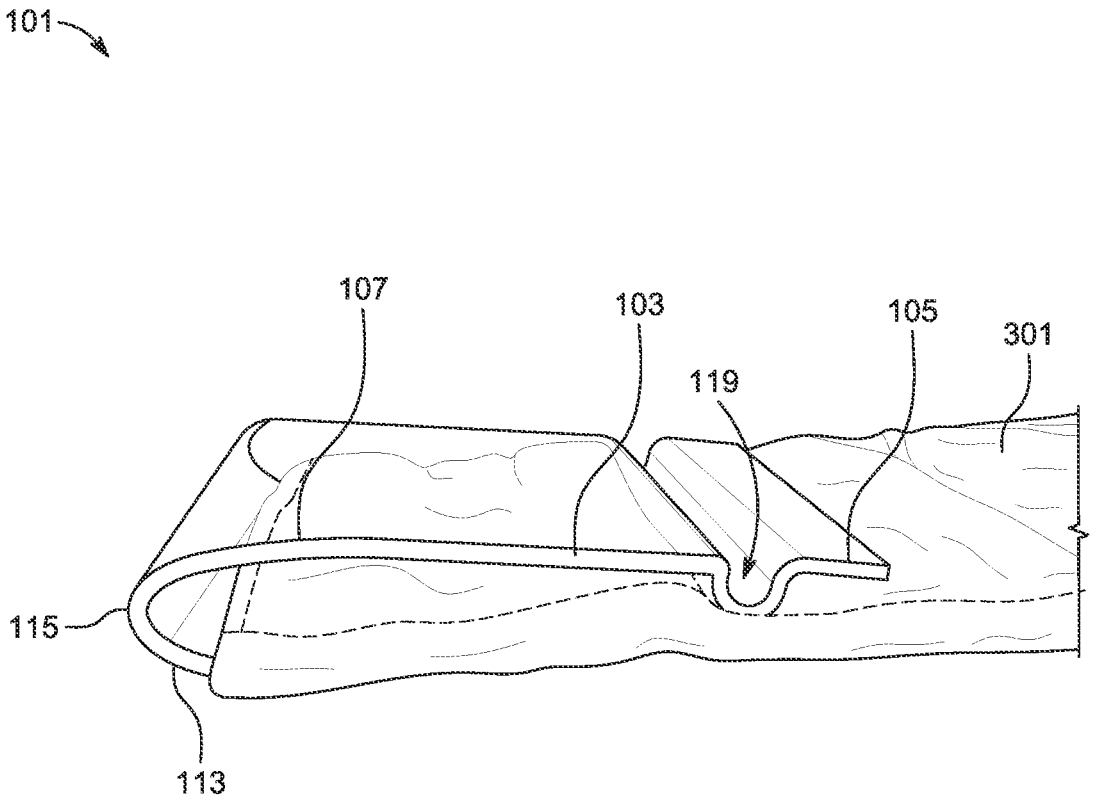
FIG. 3 is a side perspective view of a sleeve with the bedding clip of FIG. 1 partially inserted therein.

In FIG. 3, a side perspective view of a sleeve 301 with the bedding clip 101 partially inserted therein. Although the sleeve 301 is depicted as partially covering the bedding clip 101, it is contemplated that during use, the sleeve 301 completely encompasses the bedding clip 101 therein.

It should be appreciated that the sleeve 301 may be made from any suitable or desirable materials, including conventional materials known and used in the art, such as natural fibers or fabrics (e.g., cotton, silk, wool, hemp, etc.) and/or synthetic materials (e.g., acrylics, polyester microfiber, nylon, rayon, etc.) as non-exclusive examples.

It should also be appreciated that the sleeve 301 may include different colored materials, patterns, images and the like to achieve a desired aesthetic.

Figure 4:
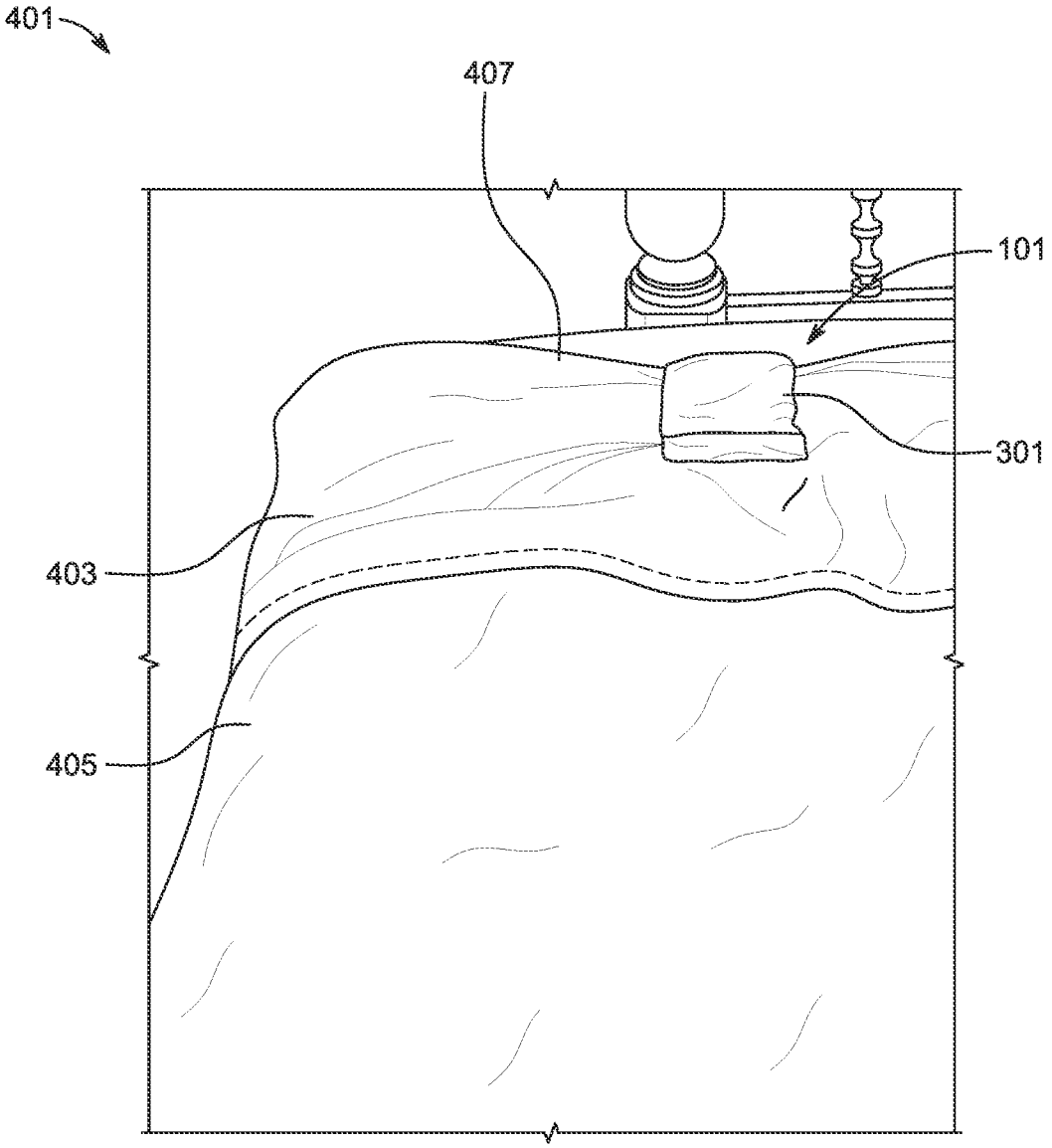
FIG. 4 is a front perspective of the bedding clip of FIG. 1 in use.

In FIG. 4, a front perspective view of the bedding clip 101 in use is depicted. As shown, a bed 401 includes a top sheet 403 and a cover 405 aligned together. During use, a portion of the top sheet 403 and cover 405 are folded, creating a folded edge 407. The bedding clip 101 is then slide into the folded edge 407 to keep the top sheet 403 and cover 405 aligned together. It should be appreciated that the bedding clip 101 may be placed anywhere along the folded edge 407 according to the user's preference.

Figure 5:
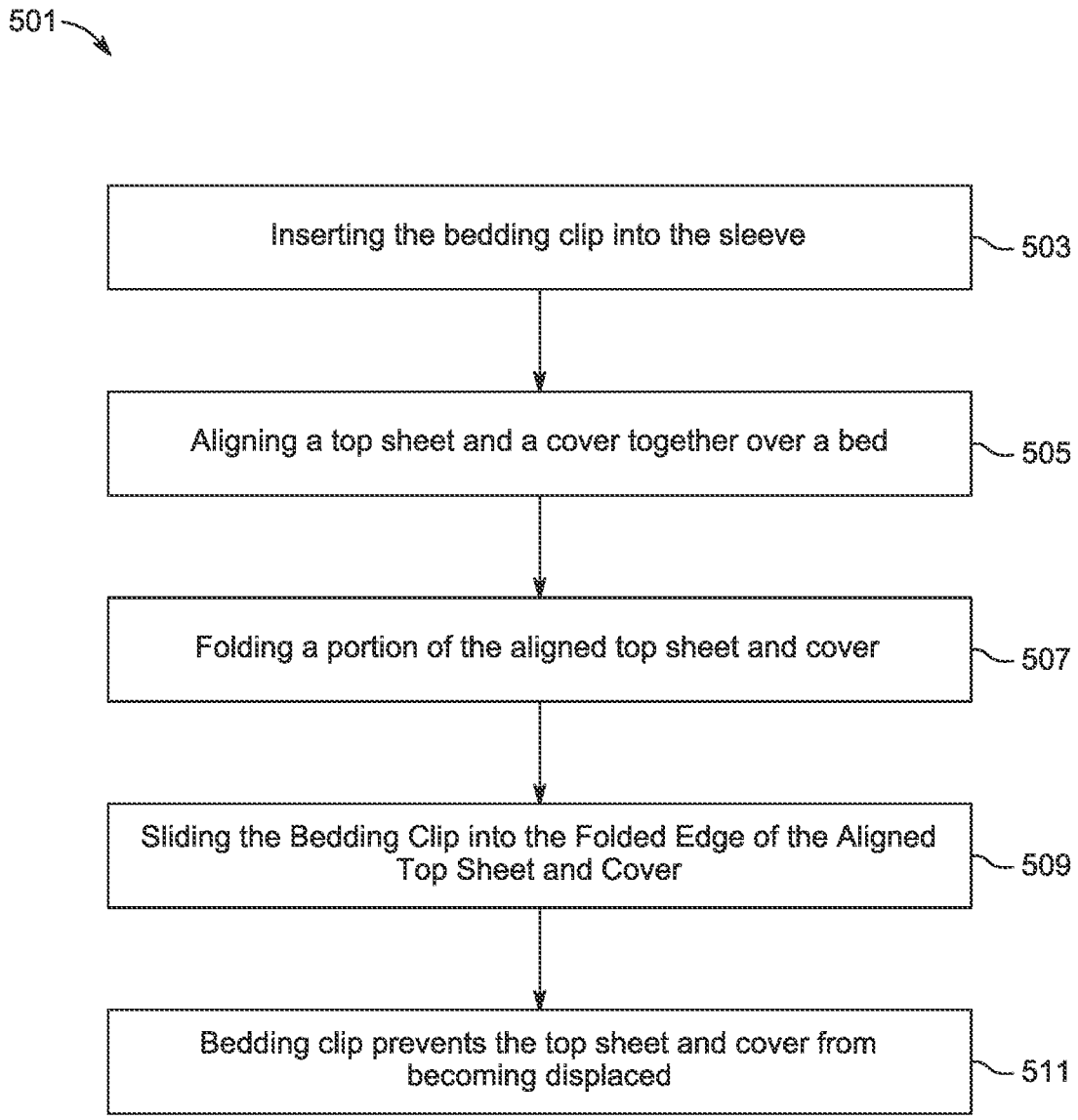
FIG. 5 is a flowchart of a method of use of the bedding clip of FIG. 1.

In FIG. 5, a flowchart 501 depicts a simplified method of use associated with the bedding clip 101. During use, the bedding clip is inserted into the sleeve, as shown with box 503. Once a top sheet and a cover are aligned together over a bed, a portion of the aligned top sheet and cover is folded, as shown with boxes 505, 507. Then, the bedding clip is slide into the folded edge of the aligned top sheet and cover, as shown with box 509. The bedding clip prevents the top sheet and cover from becoming displaced, as shown with box 511.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bedding clip, comprising:

a first jaw having first and second opposing ends, and a recessed channel extending perpendicularly thereon, the recessed channel having a first radius;

a second jaw having third and fourth opposing ends, and a cambered channel extending perpendicularly thereon, the cambered channel having a second radius, the second radius is greater than the first radius;

a coupling portion joining the first and second jaws via the second and fourth opposing ends, wherein the joining creates an opening between the first and second jaws; and a sleeve configured to encompass the bedding clip therein;

wherein the first opposing end is a free end extending away from the coupling portion;

wherein the third opposing end is a free end extending away from the coupling portion;

wherein the first and second jaws are generally parallel and opposed to one another;

wherein the recessed and cambered channels are generally parallel, opposed and offset to one another.

* * * * *